US007073673B2

(12) United States Patent
Takehara et al.

(10) Patent No.: US 7,073,673 B2
(45) Date of Patent: Jul. 11, 2006

(54) WIRE ROPE REEVING SUPPORT SYSTEM FOR CARGO CONTAINER HANDLING GANTRY CRANES

(75) Inventors: Toru Takehara, San Mateo, CA (US); Sun Huan Huang, Freemont, CA (US); Hans G. Vosskamp, San Mateo, CA (US)

(73) Assignee: PACECO Corp., Hayward, CA (US)

( * ) Notice: Subject to any disclaimer, the term of this patent is extended or adjusted under 35 U.S.C. 154(b) by 272 days.

(21) Appl. No.: 10/815,374

(22) Filed: Mar. 31, 2004

(65) Prior Publication Data

US 2005/0218100 A1 Oct. 6, 2005

(51) Int. Cl.
*B66C 21/08* (2006.01)

(52) U.S. Cl. ..... 212/323; 212/121; 212/312

(58) Field of Classification Search ..... 212/121, 212/312, 323
See application file for complete search history.

(56) References Cited

U.S. PATENT DOCUMENTS

| | | | | |
|---|---|---|---|---|
| 561,334 | A * | 6/1896 | Miller | 212/121 |
| 597,296 | A * | 1/1898 | Richson | 212/121 |
| 1,057,660 | A * | 4/1913 | Norris | 212/121 |
| 1,427,949 | A * | 9/1922 | Godfrey | 212/94 |
| 1,456,218 | A * | 5/1923 | Brightman | 212/95 |
| 2,574,473 | A * | 11/1951 | Getz et al. | 212/94 |
| 3,245,550 | A * | 4/1966 | Trutsch | 212/121 |

FOREIGN PATENT DOCUMENTS

| | | |
|---|---|---|
| GB | 1456054 | * 11/1976 |
| JP | 11-91552 | * 4/1999 |

* cited by examiner

*Primary Examiner*—Thomas J. Brahan
(74) *Attorney, Agent, or Firm*—Bruce & McCoy; Ernest H. McCoy

(57) ABSTRACT

A wire rope reeving support system for a cargo container handling crane having a transport trolley mounted for reciprocation along a horizontal gantry thereof and having a wire rope load hoisting system for the transport trolley wherein a mechanism is provided mid span of said gantry for supporting the wire ropes of at least the load hoisting system and permitting the transport trolley to actuate the rope system to let the trolley pass there by without mechanical interference.

9 Claims, 8 Drawing Sheets

WIRE ROPE REEVING SUPPORT SYSTEM FOR CARGO CONTAINER HANDLING GANTRY CRANES

BACKGROUND OF THE INVENTION

1. Field of the Invention

The present invention relates to cargo container handling gantry cranes. More particularly, it relates to an improvement in the wire rope reeving system for the cargo container transport trolley of such cranes. Specifically, it relates to a wire rope reeving support system for gantry cranes in which the rope systems which perform load hoist and trolley traversing operations are supported at least mid-span of the maximum rope suspension length of the crane.

2. Description of the Prior Art

The cargo container handling gantry cranes which benefit from the improvement provided by the present invention are those which are arranged in the operating configuration to extend over a longitudinal expanse of ground, dock, or water to transfer cargo containers horizontally from one deposition area to another. The heaviest of such gantry cranes are usually located dockside in shipping ports around the world in the form of bridge cranes or gantry cranes. Dockside gantry cranes generally have either a horizontal sliding boom or a cantilever boom, the latter of which can usually be raised by rotating it around its inboard end. An example of this latter type of crane which is more prevalent is disclosed in U.S. Pat. No. 5,765,981 and was developed by the assignee of the present invention. Other types of large gantry yard cranes are located in large cargo container storage or transfer areas. These are long span bridge cranes and are typically supported by vertical structures located inboard from both ends of the crane gantry on rail-mounted wheels.

Reference is made to FIG. 1 of the drawings for a representation of the '981 type of gantry crane having a cantilevered rotatable boom 11 projecting from the crane superstructure 13. It is supported on crane truck wheels 15 which are mounted on dock rails which run parallel to the edge of the quay. The superstructure supports a horizontal gantry 17 disposed generally mid-height thereon at an elevated location above the cargo container pickup and deposition areas 19. The gantry is supported from below by the main legs of the superstructure. In the cantilevered rotatable boom design, sheaves are disposed at the pinnacle 21 of the superstructure of the crane to guide wire rope reeving 23 which is used to rotate the outboard or cantilevered end of the boom to the upright raised stowed position. The outboard end or the middle and the end of the boom are also supported from the pinnacle by mechanical links 25 when the boom is lowered to level and the wire rope boom hoist reeving 23 is slack. The wire rope hoist reeving which raises the boom takes the load off the links which collapse when the cantilevered boom is rotated to its stowed position about its hinge point 27 at its inboard end proximate the superstructure.

While, in most typical dockside applications, the gantry of a cargo container handling crane is a horizontally slidable or a raisable cantilever boom, some gantries are single beam while most others are dual girder beam. The present invention can be utilized on any of these basic types of gantry crane designs. All of these cranes are similar to the '981 gantry type crane in that they employ a movable cargo container lift trolley 29 mounted on rails on the crane gantry sections 11 & 17, usually with a suspended operator's cab 31. The trolleys shuttle along rails usually mounted on top of, inside of, or below the crane gantry. The trolley suspends a cargo container lifting spreader 33 below the gantry. In the case of the dual girder beam gantry, the load is suspended through the center of the gantry between the gantry side girders which extend for the length of the gantry. For a single beam gantry, the trolley is suspended on rails usually mounted below the beam. The cargo container lifting spreaders are releasably suspended from the trolley, which carries the wire rope suspension sheaves for the fleet-through wire rope load hoist reeving, by means of a detachable headblock 35. Different length spreaders can be secured to the headblock to accommodate correspondingly different size containers.

The headblock 35 and spreader 33 can be raised or lowered from the crane gantry 11, 17 by the operator in the cab 31 to engage cargo containers which are located on the dock or shipboard. The spreader permits the containers to be lifted by the trolley 29 for transport along the gantry between the pickup and deposition areas 19 in a cargo container transport ship, or under the crane, or under its backreach. The trolley is reciprocated along the gantry by a continuous wire rope drive system, and the headblock is raised and lowered by a load hoisting wire rope system, both which are usually driven by wire rope drums located in a machinery house 37.

However, there are several types of wire rope reeving and trolley drives utilized in the prior art relating to effecting cargo container transfer. These include the trolley rope drives and load hoist wire ropes. The latter of these two systems primarily benefits from the implementation of the present invention, but the trolley drive ropes can also. These wire rope systems are each disclosed in the accompanying prior art drawings which illustrate typical apparatus for both the wire rope reeving for a rope drive trolley for a shoreside cargo container handling crane and a wire rope load hoisting system driven from a remote location on a crane. There is a problem with these large cranes which relates to wire rope sag and, in particular, with respect to sag in the load hoist wire rope system. When the hoist trolley traverses to the maximum outreach position, the unsupported rope span between the main hoist rope sheave on the trolley, and the hoist rope support sheave at the opposite end of the gantry, reaches a maximum. Under this condition, the hoist ropes will have a maximum sag because of the unsupported dead weight of the wire ropes. This catenary effect will become excessive when there is no load under the lifting spreader. The container load generates a downforce in the wire rope system that provides a tension force in the horizontal ropes that restrains rope sag. For cranes with higher rated lifting capacities, the main wire rope diameters are larger to handle the increased loads. Consequently, the main hoist ropes are heavier and the suspended ropes have greater sag.

The most unfavorable condition for rope sag is when the main trolley is positioned at the furthest outreach position, and when the main hoist drum has payed out the most rope in order to lower the spreader to engage a container in the hold of a ship. When the spreader is landed on the container, the main hoist ropes have the greatest slack because there is no load on the rope to maintain the tension required to minimize rope sag. The sag under these conditions can be as much as 30 feet. When the operator commences to lift an engaged container, the force created by the lifting load will suddenly take up the slack ropes generating a "rope whipping effect." This causes the ropes to bounce and to slap on the adjacent structure of the crane frame, which in turn causes structural damage as well as premature fatigue failure of the wire ropes. Sometimes the ropes will actually engage and detach a berthed ship structural element. The damaged structure can fall onto the top of the ship deck to cause further property damage and possibly personal injury or death to workers or crew. The bouncing rope also generates nuisance noise and an unsafe operating condition and can injure personnel if they happen to be near the bouncing ropes. Conversely, the same condition occurs in reverse: when a load is released under the predescribed most unfavorable condition, the same whipping effect results from the release of tension. The maximum inboard backreach retracted position of the trolley also causes an unfavorable rope sag condition and can create a whipping effect.

For those cranes built before 1985, the catenary effect on the wire rope was not severe enough to raise the operator's concern. However, as the container ships have been getting larger in size, the cranes have correspondingly become larger with boom outreaches extending further. As a result, the rail gauge for the crane dockside tracks have expanded from 50 feet to 100 feet to provide better crane operational stability against the possibility of the crane tipping over during load lifting. The unsupported wire rope span is therefore longer than prior art cranes, and this means that the main hoist ropes unsupported span becomes much more than the older cranes. Consequently, the crane lifting capacities are becoming higher requiring the use of still heavier main hoist wire ropes. This compounds the problem and creates still greater rope sag. As a result, the rope sag catenary effect has now become excessive and has created an identified safety problem.

Reference is made to FIG. 2 for an illustration of a first type of basic wire rope reeving support system utilized to alleviate the rope sag problem. It employs a pair of catenary rope support trolleys 39, 41 on the gantry 17 which are disposed on opposite sides of the main hoist trolley 29 to support the wire ropes. In this typical type of crane, the previously described two independent rope systems can be utilized: a trolley drive system and the load hoist system. Only the latter or load hoist system is shown in FIG. 2 of the drawings for clarity because some cranes do not utilize a wire rope drive system for the main trolley drive as will be explained.

Reference is made to FIG. 3 which shows the typical reeving for a main trolley traversing drive system for gantry cranes which has been omitted from FIG. 2. In the normal configuration of wire rope reeving for the drive system, a pair of continuous traversing or wire drive ropes 43 are secured to opposite ends of the cargo transport trolley 29 and are driven by one or a pair of trolley drive drums 45. The term "continuous" generally means the wire rope is a continuous loop. Portions of the rope are either towing or slack depending on the direction of movement of the trolley, and the rope is always active and continuously in motion when the trolley moves.

For the "rope trolley" type of crane of FIG. 3, the drive drums 45 for the two pairs of main trolley drive ropes 43 are usually located somewhere mid-span on the gantry 17 in a machinery house 37 (FIG. 1). The pairs of drive ropes are oppositely wound and extend from the drums to reversing sheaves 47 disposed at opposite ends of the gantry through hydraulic rope tensioners 49. The pairs of ropes reverse direction in the reversing sheaves and extend to opposite ends of the cargo container transport trolley 29 which is movably located anywhere along the gantry. Operation of the drive drums moves the trolley in one direction along the gantry while reverse rotation of the drive drums reverses the tension and slack forces in the drive ropes and the movement of the trolley.

Reference is made again to FIG. 2. In addition to the trolley drive ropes (of FIG. 3) in a "rope trolley" cargo container handling crane, a separate system of load hoist or lift ropes 51 for the lifting spreader 33 are integrated into the wire rope reeving system. They are very similar in orientation, operation, and location to the trolley drive ropes in the sense that they are also driven from a remote location by drive drums 53 located in a machinery house and run through reversing sheaves 47 at one end of the crane gantry 17. They differ, however, in that the two pairs of hoist ropes are not secured to the main trolley 29 but are reeved through fleet-through hoist sheaves 55 mounted thereon whereby they travel downward from the hoist sheaves to the headblock 35, around suspension sheaves on the headblock, back up to the trolley, around fleet through additional hoist sheaves on the trolley, and outboard therefrom to the end of the gantry where they are dead-ended 57 at the opposite end of the gantry from the reversing sheaves 47. The ropes may be multiply-reeved between the headblock and the trolley sheaves to obtain a greater mechanical advantage. The hoist ropes operate independent of the trolley drive ropes and can be static or moving as the trolley moves along the gantry depending on whether the lifting spreader headblock for the containers is being lifted or lowered concurrently while the trolley moves.

A second type of wire rope reeving for a crane can be called a "machine trolley" container crane. The hoisting machinery and the trolley traversing machinery are both mounted on the trolley. The wire ropes from the drums of the hoist machinery mounted on the trolley go down to reversing sheaves on the lifting spreader headblock and then go back up to the trolley and are dead-ended to it. The trolley traversing machinery drives the trolley wheels to move the trolley along the rails on the girder or boom of the gantry crane.

A third type of wire rope reeving can be called a "semi-rope trolley" container crane. It is a combination of the first two types. The load hoist machinery is located in the machinery house on the gantry and the wire ropes are reeved the same as for the "rope trolley" crane of FIG. 2. However, the gantry traversing machinery for the trolley is mounted thereon the same as the "machine trolley" type container crane described above.

The latter two types of prior art cranes have the following disadvantages. In both cases, the trolley traversing machinery is mounted on the trolley, and in the second type the hoisting machinery as well. The trolley becomes extremely heavy and the crane gantry girder structure required to support the trolley must necessarily be made stronger and thereby heavier. In addition, as the trolleys are driven by the wheels interconnected to the trolley traversing machinery, the wheels sometimes slip in foul conditions such as the beginning of rainfall or when the rails have early morning frost.

For the "rope trolley" type of crane, the trolley carries only fleet through sheaves and it does not have either hoisting machinery or trolley traversing drive machinery mounted on it. Therefore, the rope trolley structure is the lightest possible weight in comparison, and the trolley supporting crane structure can be built correspondingly of minimum weight. Because the rope trolley is towed by the drive ropes, there is no wheel slip. However, as the long length of the wire ropes for the hoist machinery and the trolley traversing machinery are reeved from the machinery house to both of the girder ends and to the trolley, the wire ropes experience considerable sag and wear and incur higher maintenance costs.

In order to mitigate the rope sag problem, various solutions have been utilized. Reference is again made to FIG. 2 wherein a first solution has been shown employing a pair of catenary rope support trolleys. A waterside catenary trolley 41 is installed between the main trolley 29 and the boom tip equalizer platform. A landside catenary trolley 39 is also installed between the main trolley and the trolley girder end tie on the opposite side of the main trolley from the waterside catenary trolley. As the rope trolley is moved by the towing ropes to the waterside greatest outreach position, the landside catenary trolley is pulled by the main trolley and moves to the mid span distance between the trolley girder end tie and the main trolley frame. By doing this, the landside catenary trolley provides a support for the main hoist wire ropes and the trolley towing ropes which decreases the rope sag in both to 25 percent of the original sag. As the main trolley moves back to the furthest landside backreach position, the waterside catenary trolley is pulled by the main trolley and travels to the mid span distance between the boom tip equalizer platform and the main trolley to provide the rope support for the waterside trolley drive and hoist ropes as did the landside catenary trolley. The catenary trolleys are actuated by an unpowered continuous wire rope system engaged with the main trolley. As the main trolley moves, the catenary trolleys move in unison. A rope tensioning system is also provided to eliminate rope slack and to help keep rope tension in the catenary rope reeving system.

There are several disadvantages to the catenary trolley rope support system:

1. The added catenary trolleys (at least two) add substantial expense to the construction of the crane not only for their cost but for the increased size of the gantry girders required to support the added weight. The main trolley drive system must tow the catenary trolleys during all traversing motion. This increases the power requirements of the main trolley drive system and decreases the efficiency of the crane.

2. The waterside catenary trolley is positioned on the gantry between the main trolley and the boom tip equalizer sheaves. This means that increased cost for extra boom length (between 5 to 7 feet) is required to permit insertion of the waterside catenary trolley. Because the boom of the crane must be raised to the stowed position when the crane is not in operation, the boom hoist mechanism is required to lift up the extra boom length weight plus the additional weight of the waterside catenary trolley. As a result, the size of the boom hoist mechanism required for the boom lifting system must also be increased. These additional increased costs include larger electrical motors, larger gear reduction units, and all the necessary couplings and associated equipment.

A landside catenary trolley is placed between the main trolley and the girder end sheaves. This also means that extra inboard end girder and rail length (between 8 to 10 feet) is required to contain the landside trolley. This extension will also add weight as well as substantial cost to the crane for the additional trolley and gantry length and strength.

3. A catenary trolley rope support system requires the installation of additional pairs of towing ropes, the catenary trolley sheaves and clamps on the main trolley, and a hydraulic tensioning system. Because it is a hydraulic system, it is not environmentally friendly due to the possible leakage of oil to the ground and to the water. This adds to the service and maintenance requirements for those items. All of the ropes require frequent lubrication. To service the towing ropes and sheaves, several maintenance access platforms must be installed. The two catenary trolleys also require access platforms to perform the maintenance such as to change bearings, axles, and wheels.

4. The waterside catenary trolley is necessarily located between the boom hinge point and the boom tip equalizer platform. When the main trolley is at the parking position somewhere intermediate the gantry between the boom hinge point and the rear girder tie, the waterside catenary trolley is located on the boom somewhere mid-span from the boom hinge point to the boom tip equalizer platform. When the boom is raised to the stowed position, the waterside catenary trolley is lifted up with the boom and hung in the air supported by the catenary tow ropes. This adds a safety concern about should the ropes fail. Rope failure will permit the catenary trolley to drop to the ground or on top of the ship deck to cause severe property damage and possible personal injury. No safety locks or stops can arrest three tons of descending trolley weight which can exceed 100 mph impact speed.

5. In some cases, crane operators request the capability for the main trolley to traverse between the legs of the crane while the boom is raised to the stowed position. This complicates the operation of the waterside catenary trolley since it must be powered to move up and down along the trolley rails with the boom projecting upward at an 84 degree angle. This increases the power requirements as well as the safety concerns for this system.

6. The total manufacturing and maintenance costs for the catenary trolley rope support systems, including the required extra boom and girder lengths, two catenary trolleys, sheaves, wheels, axles, reeving of the towing ropes, hydraulic cylinders, the rope tensioning system, and higher boom lifting horsepower required to lift the heavier boom with a catenary trolley, is very high.

Reference is made to FIG. 4 which shows another type of rope support system which utilizes multiple fixed position rope support rollers 59 mounted on the gantry girders. This system requires installing multiple reversing sheaves 61 on the main trolley frame 29 and requires employing several reverse rope bends in a short distance on the main hoist ropes which shortens the hoist rope life significantly. This rope reeving arrangement could reduce the main hoist rope fatigue life to 50 percent or less than the original life without the rope support system. The rope fatigue life is determined by how many wire strands are allowed to break before mandatory rope replacement for operational safety concerns. This is costly due to the operation losses and maintenance costs. As a result, this system has not proved practical in the container crane industry.

The present invention provides an improvement in wire rope support systems for a crane's wire rope reeving which reduces the effects of the disadvantages in the prior types of similar crane wire rope support systems.

SUMMARY OF THE INVENTION

The present invention is a wire rope reeving support system for a cargo container handling crane having a cargo transport trolley mounted for reciprocation along a horizontal gantry thereof and for suspending a load thereunder. The crane has a fleet through wire rope load hoisting system for the transport trolley driven from a remote location on the crane.

The rope support system of the present invention is comprised of at least two pairs of bellcranks and push rods secured in opposed relation to the opposite longitudinal edges of the gantry intermediate the ends thereof. The bellcranks are pivoted at their respective first ends to the gantry, with the opposite ends thereof each having at least one wire rope support roller rotatably engaged therewith and formed to project under and support the adjacent portion of the wire ropes of the wire rope load hoisting system when the bellcranks are oriented in a first "resting" position. The rollers are formed to retract from under the wires and project clear of the trolley when the bellcranks are oriented in a second "actuated" position.

The push rods are contained in vertical tracks which are secured to the opposite longitudinal edges of the gantry adjacent to the bellcranks, and the rods are formed for reciprocation in the tracks. Connecting rods are provided for each of the bellcrank and push rod pairs. The connecting rods have a first end journalled to the push rods, and the opposite ends thereof are journalled to the bellcranks intermediate the ends thereof between the pivoted ends of the bellcranks and the roller engagements therewith.

At least a pair of push rod actuators are secured to the trolley and aligned with the lower ends of the push rods whereby, as the trolley passes the push rod locations during reciprocation of the trolley along the gantry, the push rod actuators actuate the lower ends of the rods to cause them to reciprocate vertically upward from the first position orientation in response to longitudinal movement of the actuators.

The upper ends of the push rods are individually interconnected by the connecting rods to the bellcranks intermediate to the ends thereof, and movement of the push rods moves the connecting rods and thereby the bellcranks to the second actuated position orientation when the push rods are at their raised positions. In this orientation, the support rollers are retracted clear of the trolley to let the trolley pass without mechanical interference with the rope support rollers. When the push rods lower the bellcranks by means of the connecting rods to the first resting position, when the actuators are out of contact with the push rods, the support rollers project under and support the adjacent wire ropes.

The present invention also provides a method for supporting the wire rope reeving for a cargo container handling crane having a cargo transport trolley mounted for reciprocation along a horizontal gantry thereof and for suspending a load thereunder. The crane has at least a fleet through wire rope load hoisting system for suspending a cargo container headblock from the transport trolley.

A pair of wire support rollers are provided in opposing positions on opposite longitudinal edges of the crane gantry and project under those portions of the wire ropes of the wire rope load hoisting system which are disposed proximate to the gantry edges. The rollers each are mounted on one end of a bellcrank pivoted at the other end thereof to the structure engaged with the gantry.

The bellcranks are actuated by push rods through connecting rods secured between the bellcranks and the push rods. Push rod actuators on the transport trolley are arranged to reciprocate the push rods vertically whereby, as the push rods are raised by the actuators, the rollers are retracted from under the wires. When the push rods are lowered by being out of contact with the actuators, the rollers are interposed under the wires. The apparatus is actuated when the trolley is moved back and forth along the gantry past the position of the support rollers on the gantry to actuate the push rods to insert and remove the support rollers from under the wire ropes.

OBJECTS OF THE INVENTION

It is therefore an important object of the present invention to provide an improved wire rope reeving support system for cargo container handling gantry cranes for the purpose of reducing rope sag;

It is another object of the present invention to provide a simplified wire rope support system for cargo container handling gantry cranes which is less costly to manufacture and simpler to install;

It is a further object of the present invention to provide an improved wire rope support system which can be installed on existing cranes or retrofitted as an improvement item requiring fewer structural modifications to the crane than other forms of retrofit;

It is yet another object of the present invention to provide an improved wire rope support system which is safer to operate than other rope support systems;

It is yet a further object of the present invention to provide a rope support system which can be retrofitted to existing cranes without increasing the energy output of the cranes' drive systems;

And it is still another object of the present invention to provide an improved wire rope support system which is easier and less costly to service and maintain.

Other objects and advantages of the present invention will become apparent when the apparatus and method of the present invention are considered in conjunction with the accompanying drawings.

DESCRIPTION OF THE PREFERRED EMBODIMENT

Figure 1:
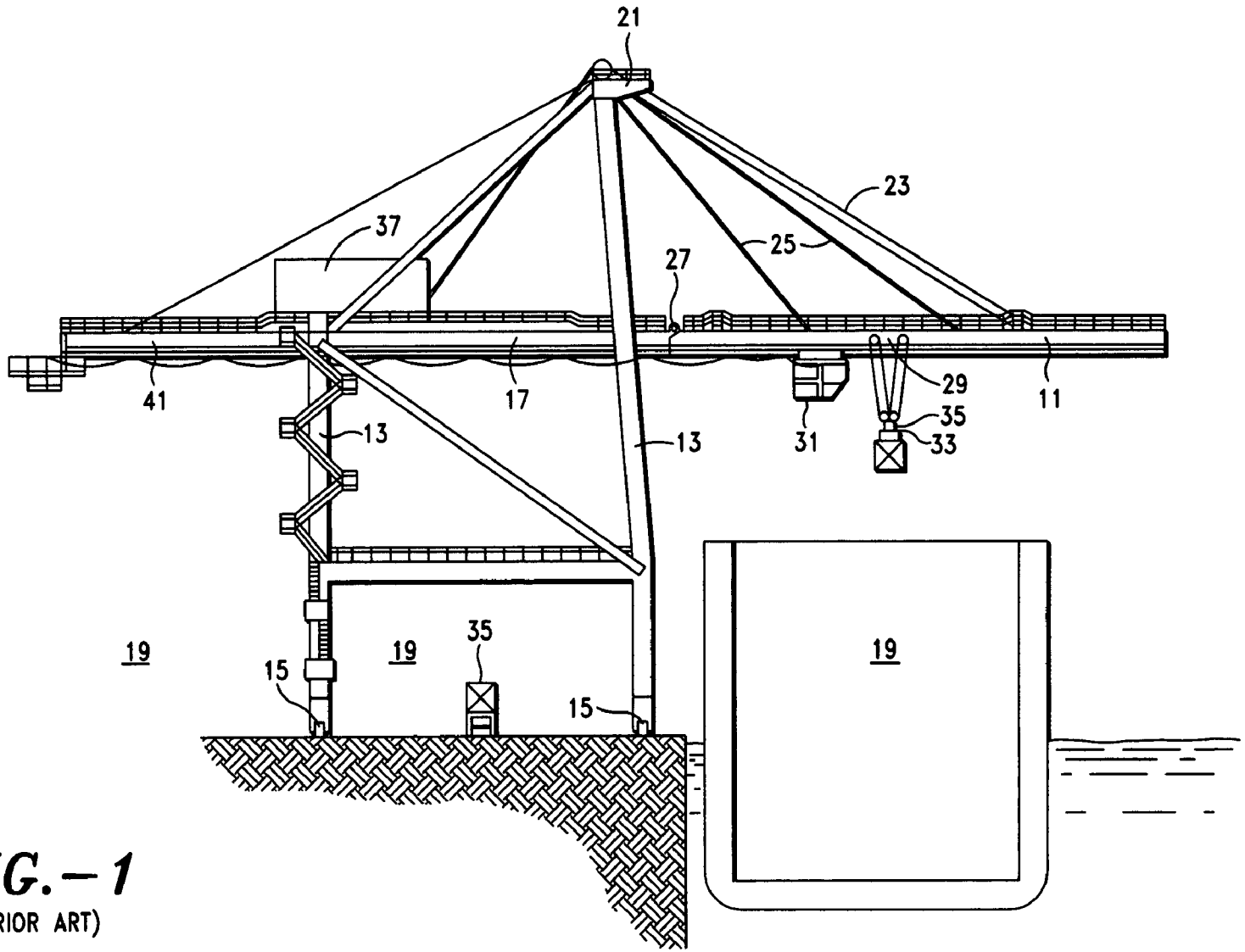
FIG.—1 (PRIOR ART)
FIG. 1 is a side elevation of a typical prior art shoreside cargo container handling gantry crane having a cantilevered raisable boom which can utilize the improvement apparatus of the present invention.

Reference is made to the drawings for a description of the preferred embodiment of the present invention wherein like reference numbers represent like elements on corresponding views. The present invention is a wire rope reeving support system for cargo container handling cranes, an example of which is shown in FIG. 1. It has a cargo transport trolley 29 mounted for reciprocation along a horizontal gantry 17 thereof and for suspending and transporting a load thereunder. The gantry can be either single beam or dual girder beam construction.

Figure 2:
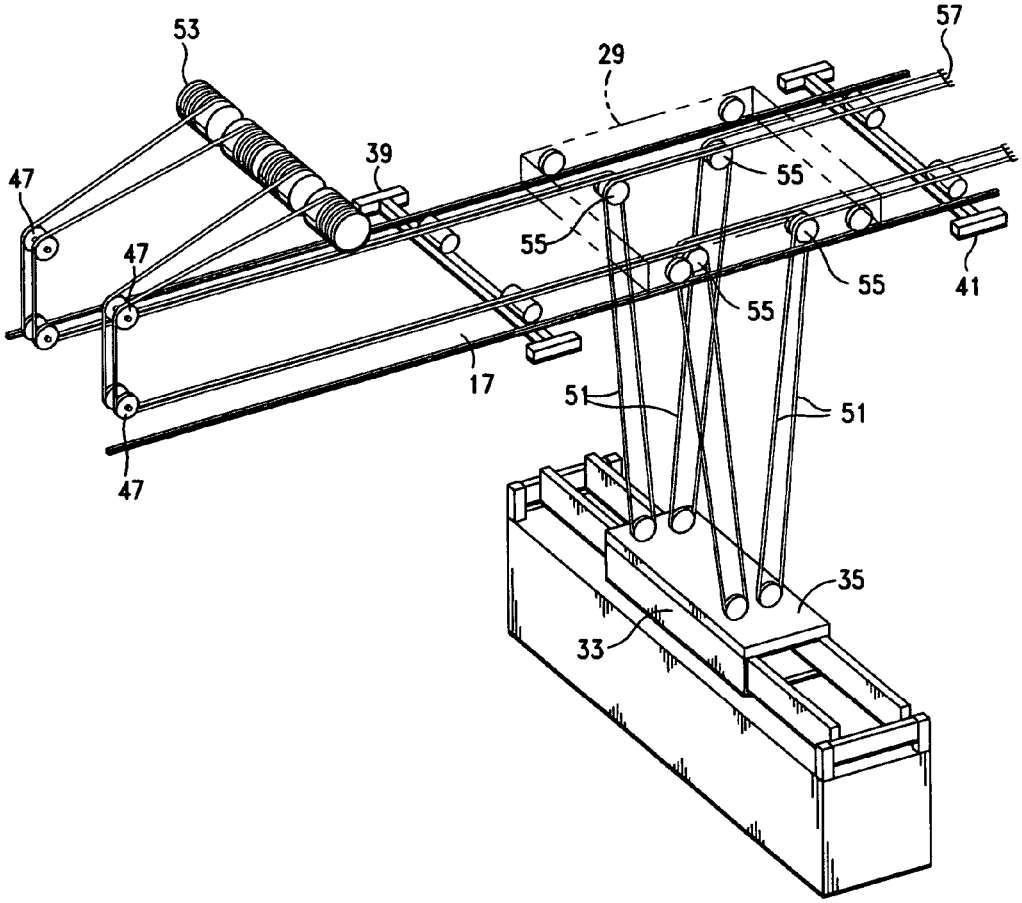
FIG.–2 (PRIOR ART)
FIG. 2 is a perspective view of the basic wire rope reeving diagram of the wire rope load hoist system for a cargo container handling trolley crane of the prior art employing a pair of prior art catenary trolleys to alleviate rope sag.
Figure 3:
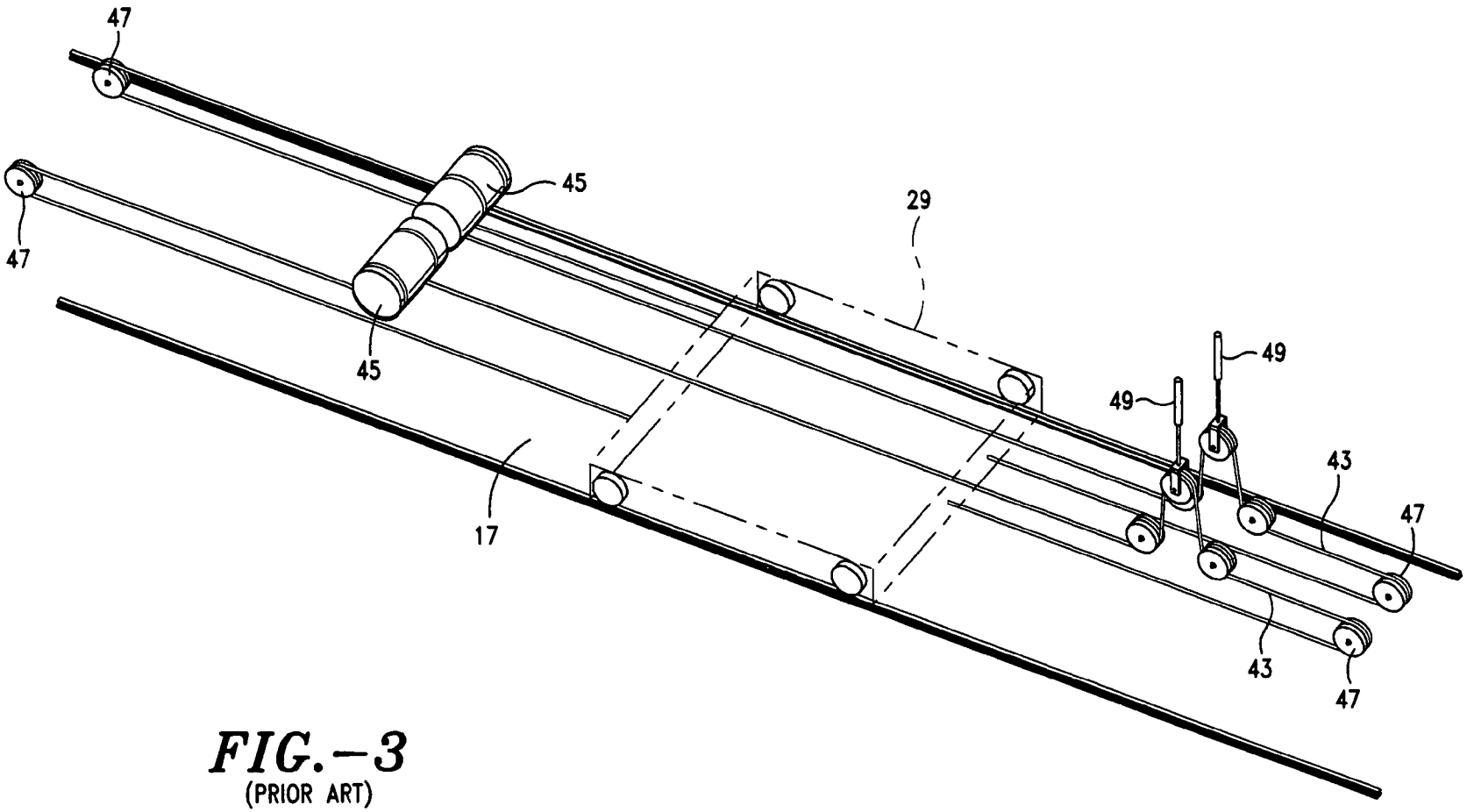
FIG.—3 (PRIOR ART)
FIG. 3 is a perspective view of a typical gantry trolley wire rope drive system of the prior art.
Figure 4:
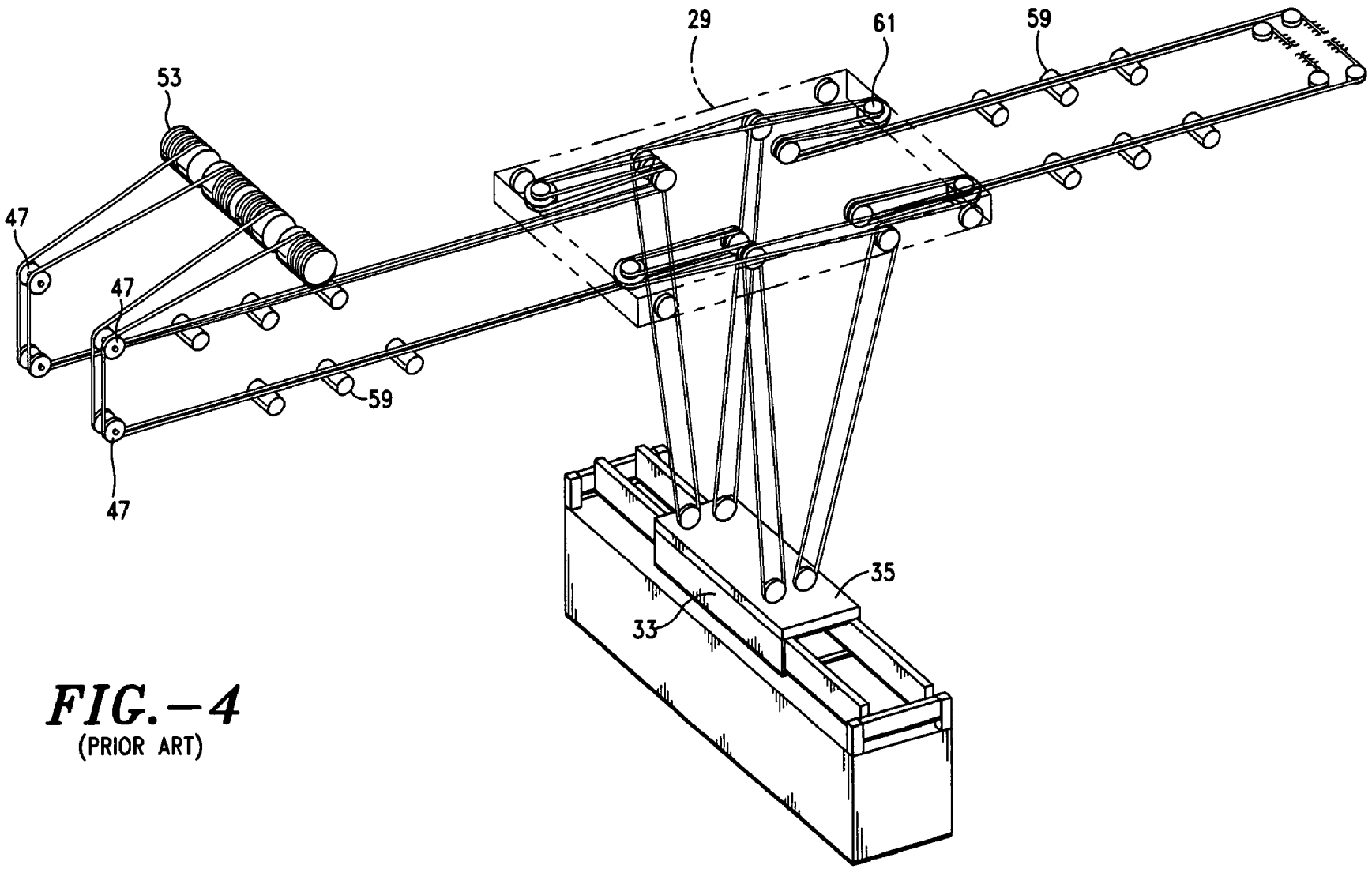
FIG.—4 (PRIOR ART)
FIG. 4 is a perspective view of an alternative prior art wire rope reeving and support system for the hoist wire ropes for alleviating rope sag in a rope trolley container crane.

The system is for use with a "semi rope trolley" drive or a "balanced rope trolley" drive which are comprised of at least a fleet through wire rope load hoist system that can be driven from a remote location on the crane and can be electronically and manually controlled. It can also include an integrated wire rope trolley drive. Reference is made to FIG. 2 of the drawings which shows the load hoisting wire rope system most commonly modified by the present invention. The purpose of the present invention is to avoid the need for a pair of catenary trolleys to prevent rope sag by means of a lighter and more effective apparatus.

The wire rope reeving support system of the present invention is designed for retrofit or original equipment installation on cargo container handling gantry cranes having a cargo transport trolley 29 mounted on the gantry thereof 17 employing a remotely driven load hoist system with the hoist drums 53 in a machinery house. The trolley is formed for horizontal reciprocation along the gantry and for suspending a load from the trolley from under a single beam, or through the gantry between the side girders thereof, and for transport of the suspended load from one end of the gantry to the other between the various pick-up and deposition areas.

The present invention is an improvement apparatus for supporting one or more portions of the two wire rope reeving systems of a balanced rope trolley at some position intermediate of the variable positions of the trolley on the crane gantry. The rope support system can either support just the load hoist ropes, if the crane has a machine drive trolley or if the trolley drive ropes do not need to be supported, or support both the load hoist ropes and the trolley drive ropes.

The rope support system includes at least a pair of rope support mechanisms which are mounted on the opposite longitudinal edges of the crane gantry approximately in the middle thereof. This means that they are positioned across from each other on the gantry in mirror image opposing locations. In the case of a single beam gantry, the pairs of mechanisms are disposed in opposed relation along the outboard longitudinal edges of the gantry. In a dual girder beam gantry, the mechanisms are usually disposed on the opposing interior walls thereof.

A single pair of mechanisms could be mounted in opposed relation approximately mid-length of the gantry to support the ropes approximately in the middle of the rope sag when the transport trolley is positioned at either end of the gantry. Alternatively, the support system can include multiple pairs of opposing rope support mechanisms disposed in spaced relation along the gantry to provide multiple support points to the ropes. Thus, the term "at least" is used in the claims to signify that multiple pairs of mechanisms or the elements thereof are contemplated by the invention as well as the single pair of the preferred embodiment.

Figure 5:
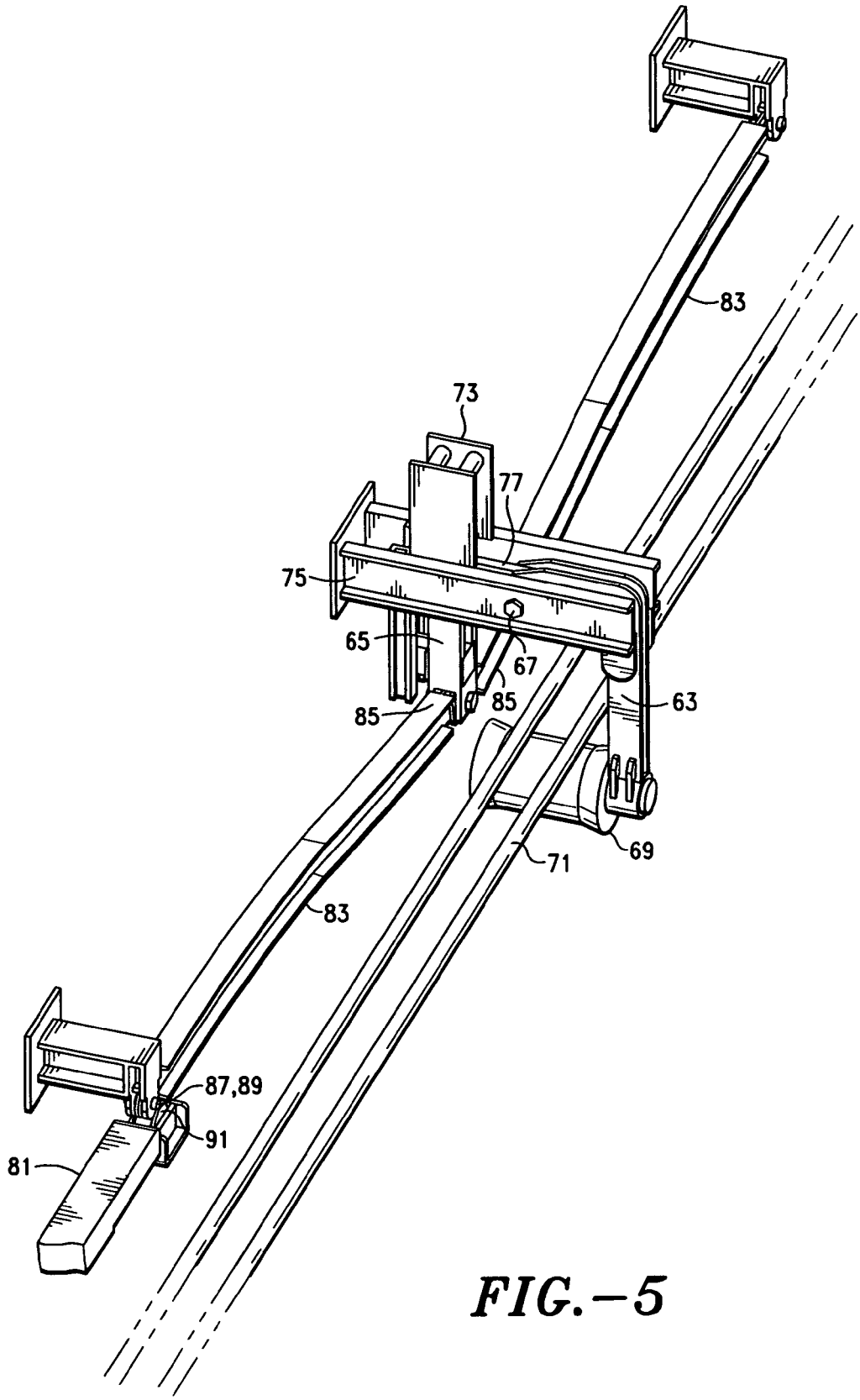
FIG. 5 is a perspective view of the wire rope support mechanism of the present invention with the rope support roller oriented horizontally for supporting the wire ropes.
Figure 6:
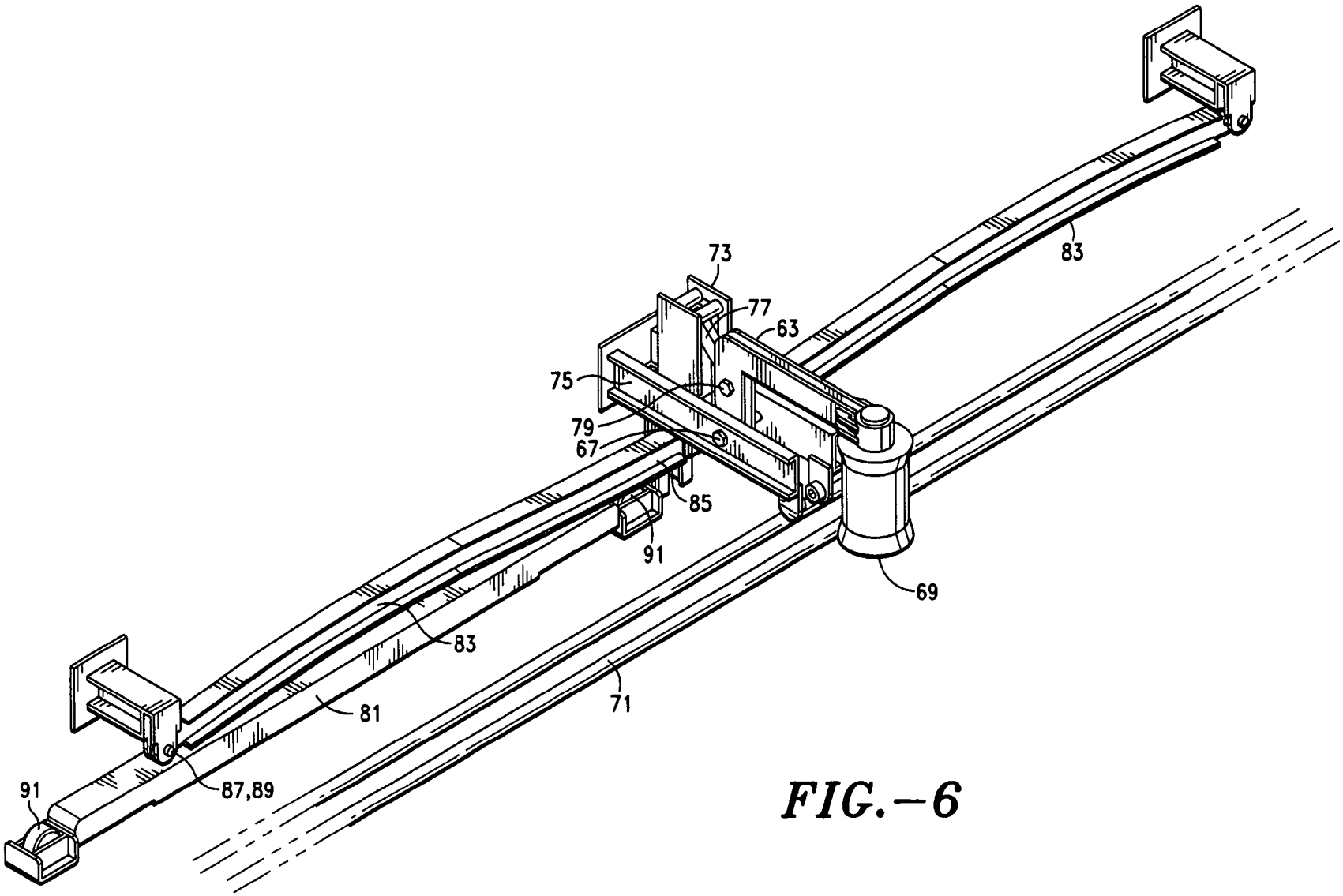
FIG. 6 is a perspective view of the wire rope support mechanism of FIG. 5 in the retracted position with the rope support roller oriented vertically for allowing the hoist trolley to bypass the rope support mechanism without mechanical interference.
Figure 7:
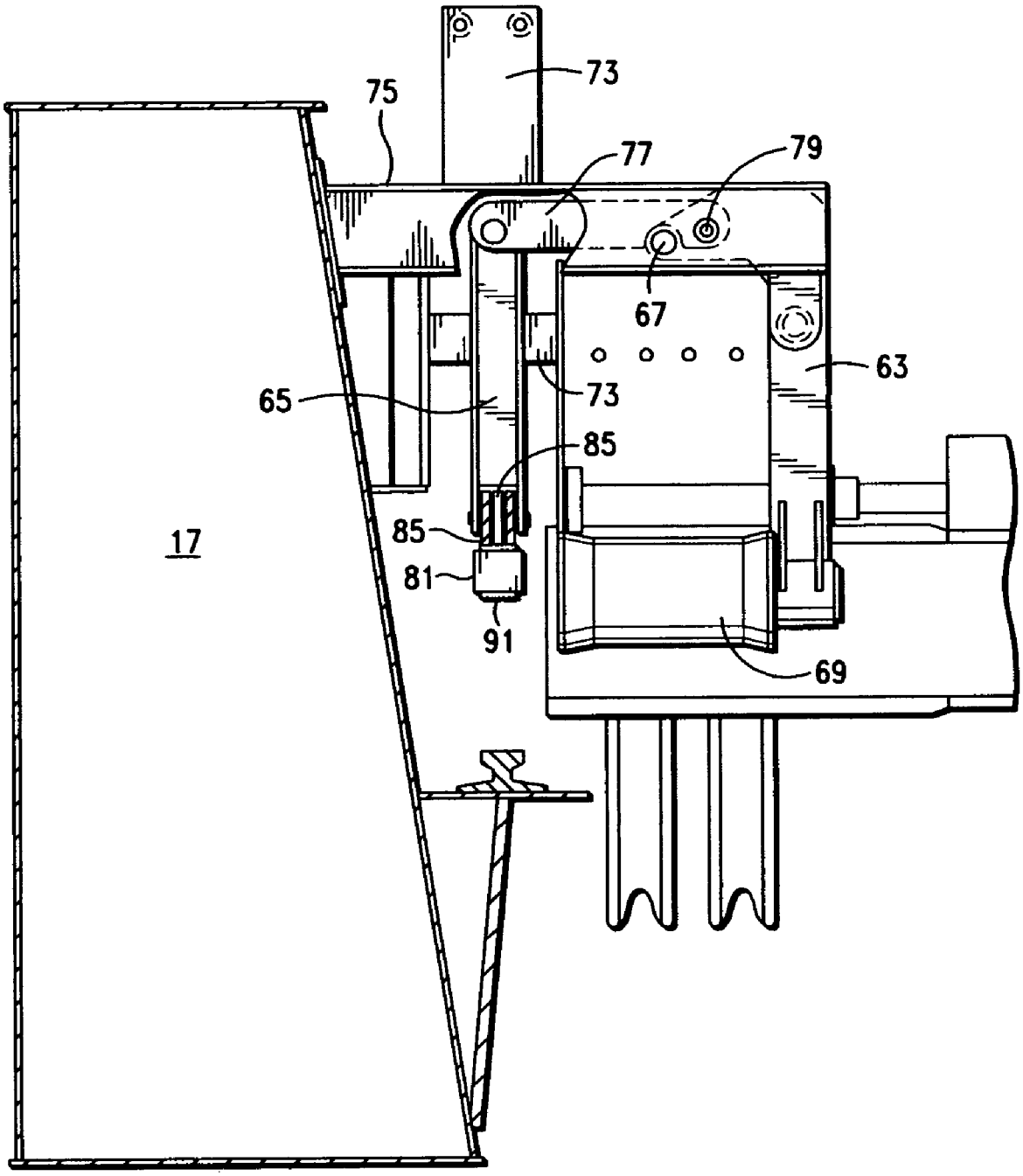
FIG. 7 is an end elevation view in section of the wire rope support mechanism of the present invention partially broken out with the support roller in the condition of FIG. 5 supporting wire ropes.
Figure 8:
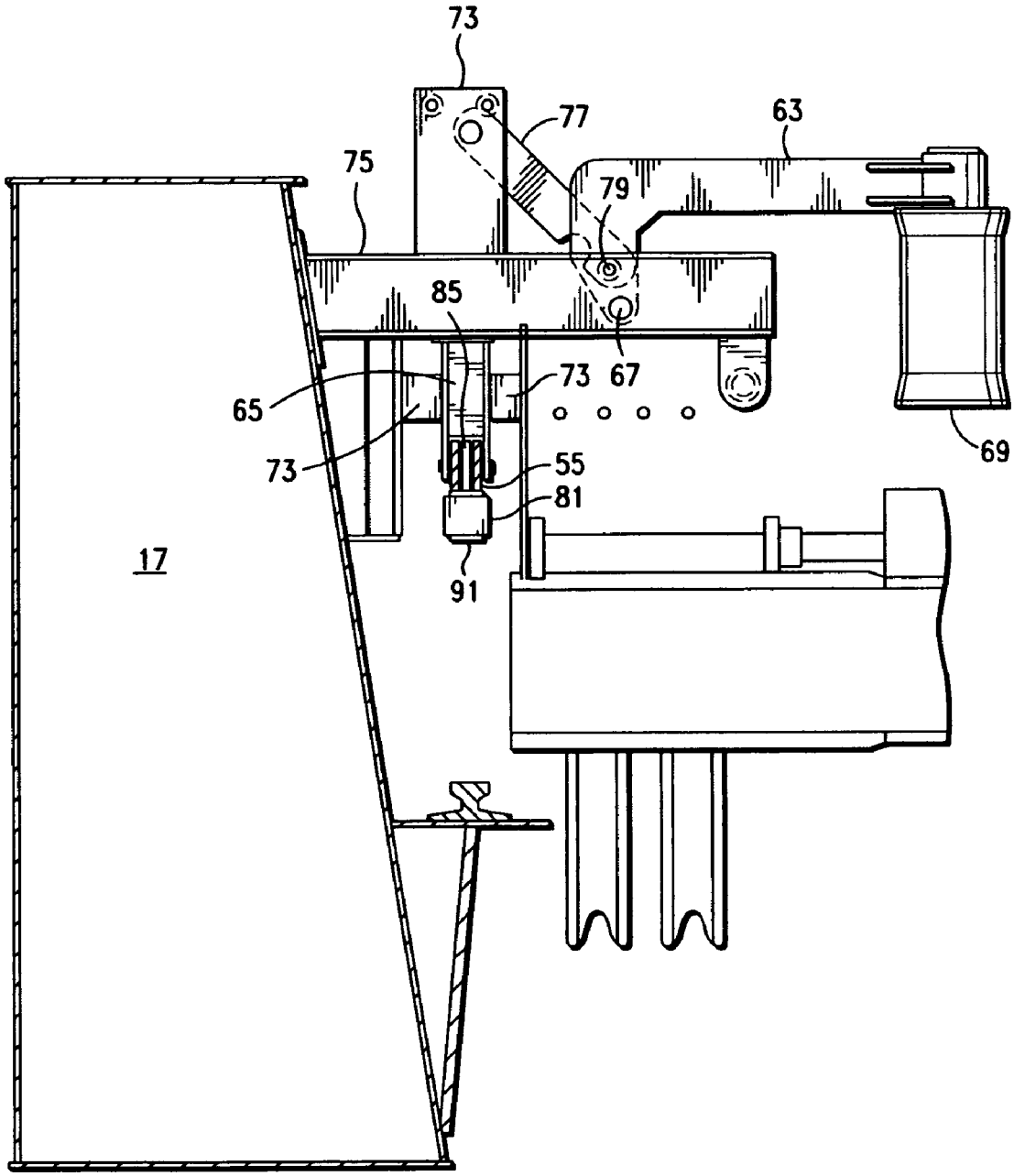
FIG. 8 is an alternative view of FIG. 7 in the condition of FIG. 6.

Reference is made to FIGS. 5–8. At least two pairs of bellcranks 63 and push rods 65 are secured to the opposite longitudinal edges of the gantry in opposed relation intermediate the ends thereof. The bellcranks are pivoted 67 at their respective first ends to the gantry 17 with the opposite ends thereof each having at least one wire rope support roller 69 rotatably engaged therewith. The rollers are formed to project under and support the adjacent portion of the wire ropes 71 when the bellcranks are oriented in a first position (FIGS. 5 & 7). The rollers are formed to retract from under the wires and project clear of the trolley when the bellcranks are oriented in a second position (FIGS. 6 & 8). The rollers can either support just the load hoist ropes or, with multiple rollers, both the load hoist ropes and the trolley drive ropes.

The push rods 65 are contained in vertical tracks 73 which are in turn mounted in brackets 75 which are secured to the opposite longitudinal edges of the crane gantry such that the brackets are disposed one each on each edge of the gantry in opposed mirror image relation locations. The tracks are formed to permit the push rods to reciprocate vertically therein. In a dual girder beam gantry, the longitudinal edges of the gantry are comprised of the gantry girder beams, and the brackets are secured to the interior walls of the girders. For a single beam gantry, the brackets are suspended from the edges of the beam.

Each of the bellcranks 63 is pivoted at their respective first ends thereof 67 in the same brackets 75 which hold the vertical tracks 73 for the push rods 65. This bracket structure establishes the relation between the push rods and the bellcranks and effects the interconnection of the first ends of the bellcranks to the gantry. The opposite ends of the bellcranks journal the wire rope support rollers 69.

The bellcranks 63 are actuated by the push rods 65 through connecting rods 77 secured between the bellcranks and the push rods. The connecting rods extend between the tops of the push rods and offset journal connections 79 on the bellcranks which are located intermediate the pivoted ends of the bellcranks 67 and the rollers 69 which are journalled on the lower ends of the bellcranks. As a result of the structural geometry, which is best shown in FIGS. 7 and 8, lowering the push rod pushes on the bellcrank to rotate it about its pivot point on the gantry to lower its outboard end to orient it at the first position. Raising the push rod pulls on the connecting rod to rotate the bellcrank to the second position.

In the first resting position of the bellcrank 63, when the push rod 65 is lowered, the bellcrank is rotated about the first end thereof 67 which is pivoted to the gantry, and the roller 69 is translated to project under and support the adjacent portion of the wire ropes 71 of the wire rope load hoisting system. When the push rod is actuated whereby it is positioned at its raised position, the bellcrank is rotated approximately 90 degrees about its pivot to the gantry to a second or actuated position, and the roller is retracted from under the wires and projects clear of the trolley to avoid mechanical interference therewith when the trolley passes the location of the rope support mechanisms on the gantry. A second roller can be positioned below the shown roller to support an additional set of wire ropes such as the trolley drive ropes.

At least a pair of push rod actuators 81 are secured to the trolley and aligned with the lower ends of the push rods 65 and parallel to the gantry edges whereby, as the trolley passes the push rod locations during reciprocation of the trolley along the gantry, the lower ends of the rods reciprocate vertically in response to movement of the actuators. The upper ends of the push rods are individually interconnected by the connecting rods 77 to the bellcranks 63 intermediate to the ends thereof. Reciprocation of the push rods moves the connecting rods and thereby the bellcranks between the first and second positions. The actuators move the push rods vertically to raise and lower the push rods whereby as the trolley passes the brackets' locations, the wire rope support rollers 69 are retracted clear of the trolley to let the trolley pass without mechanical interference with the rope support rollers.

In the preferred embodiment of the invention, each of the rope support mechanisms has two pairs of essentially mirror image elongated cam surfaces 83 mounted in end-to-end alignment with respect to each other with one pair each being mounted on opposite sides of the gantry. In a twin girder gantry, the cam surfaces are positioned on opposite inside surfaces of the gantry side girders approximately mid span thereof, and in a single beam gantry, on the outer edges thereof, so that when the trolley is located at its most outboard or inboard position of gantry movement, the wire rope support system is generally disposed mid-length of the maximum wire rope suspension length which extends between the trolley and the opposite end of the crane gantry.

The adjacent ends 85 of the cam surfaces 83 are centered under the lower ends of the push rods 65 and are intermeshed and pin journalled to the lower ends of the push rods whereby the two adjacent ends 85 of the cam surfaces and the push rods reciprocate vertically together in unison. The push rod actuators 81 contact the bottoms of the cam surfaces as the trolley traverses the positions of the cam surfaces secured to the gantry and causes them to rise.

The cam surfaces 83 are journalled with a slotted connection 87 at the opposite outboard ends thereof so that the inboard adjacent ends 85 of the cam surfaces can move vertically rather than in an arc around the journalled end. The slotted connection includes a pin 89 projecting from the gantry which projects through a horizontal slot in the outboard ends (from the adjacent ends) of the cam surfaces. The pins are capped to capture the cam surfaces and to permit a slight sliding and partial rotating motion of the cam surfaces on the pins thereby effecting a journalled connection.

In the preferred embodiment of the present invention, the push rod actuators 81 are also the cam surface actuators. They are extended length essentially flat surfaces secured to the trolley. They have rollers 91 at the ends thereof to initiate and terminate contact with the cam surfaces 83 as the trolley moves past the rope support system locations on the gantry. The wire ropes 71, both load hoist and trolley drive, are highest at the trolley because they are either secured to it or reeved through sheaves carried by it. The wire rope support rollers 69 on the bellcranks 63 transition under the ropes most easily when the trolley passes the rope support system stations on the gantry. As the trolley reciprocates along the gantry, the cam actuators on the trolley engage and raise and lower the cam surfaces. The actuators initially raise the first cam surface they contact and then start lowering the second cam surface when they pass mid-point under the push rods and contact the second cam surface. The process is reversed when the trolley reverses direction. The cam surfaces smooth the rocking action of the bellcranks.

Reference is made to FIG. 5 which shows the cam actuator 81 secured to the trolley just approaching and making contact with the cam surface 83 from the bottom of FIG. 5. The leading roller 91 on the actuator is just entering under the pivoted end 87 of the cam surface. Reference is made to FIG. 6 which shows the cam actuator progression where it is engaged with the cam surface with the lead roller just approaching midpoint where the floating ends 85 of both cam surfaces and the lower end of the push rod are rotatably pinned. At that point in the trolley progression, the bellcrank 63 has been raised to its second position and has retracted the wire support roller 69. As the cam actuators clear past the position of the cam surfaces, the cam surfaces move gently downward permitting the push rods to lower, thereby actuating the bellcranks to smoothly translate the rope support rollers underneath the wire ropes 71 for support.

The present invention also contemplates a new and novel method for supporting the wire ropes for a cargo container handling gantry crane having a cargo transport trolley mounted for reciprocation along a horizontal gantry thereof and for suspending a load thereunder. The crane has at least a fleet through wire rope load hoisting system for suspending a cargo container headblock from the transport trolley. A pair of wire support rollers is provided in opposing positions on the opposite longitudinal edges of the crane gantry. The rollers project under those portions of the wire ropes of the wire rope load hoisting system which are disposed proximate to the gantry edges. The rollers are each mounted on one end of a bellcrank pivoted at the other end thereof to the structure engaged with the gantry. The bellcranks are actuated by push rods through connecting rods secured between the bellcranks and the push rods. The steps of the method comprise providing actuators on the transport trolley arranged to reciprocate the push rods vertically. The push rods are engaged to the bellcranks whereby, as the push rods are raised by the actuators, the rollers are retracted from under the wires, and when the push rods are lowered by being out of contact with the actuators, the rollers are interposed under the wires. The method is actuated by moving the trolley back and forth along the gantry past the position of the support rollers on the gantry to actuate the push rods and insert and remove the support rollers from under the wires.

The method also includes providing at least two pairs of elongated cam surfaces secured to opposite longitudinal edges of the gantry to effect a controlled reciprocation of the push rods when the push rod actuators, now the cam actuators, reciprocate the cam surfaces vertically when the trolley passes the surfaces.

From the foregoing description of the preferred embodiment of the present invention, it can be seen that the wire rope reeving support system can achieve the stated objects and advantages of the invention, and that the new and novel apparatus improvement overcomes the disadvantages earlier described in the Description of the Prior Art portion of this specification. It is obvious that the design of the present invention can be utilized for larger cranes for handling larger cargo containers and loads by installing more than one set of rope support systems on the girder walls. Therefore, when reference is made to "a rope support system" for "cargo container cranes," additional pairs of support rollers can be substituted for the single set. Likewise, when the term "a roller" is referred to herein, multiple rollers can be substituted therefor by providing multiple rollers on the bellcranks.

Thus, the present invention permits a lightweight and economical wire rope support system which is far lighter than for the double catenary trolley cranes as well as lighter than for the multiple support roller mechanisms of the prior art. However, the present invention eliminates rope wear and minimizes wire rope reeving, thereby requiring considerably less maintenance cost than comparable multiple trolley cranes.

Thus, it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

We claim:

1. A wire rope reeving support system for a cargo container handling crane having a cargo transport trolley mounted for reciprocation along a horizontal gantry thereof and for suspending a load thereunder, said crane having a fleet through wire rope load hoisting system for said transport trolley driven from a remote location on said crane, said rope support system of the present invention comprising at least two pairs of bellcranks and push rods secured in opposed relation to the opposite longitudinal edges of said gantry intermediate the ends thereof, said bellcranks being pivoted at their respective first ends to said gantry with the opposite ends thereof each having at least one wire rope support roller rotatably engaged therewith and formed to project under and support said adjacent portion of said wire ropes of said wire rope load hoisting system when said bellcranks are oriented in a first resting position and said rollers being formed to retract from under said wires and project clear of said trolley when said bellcranks are oriented in a second actuated position, said push rods being contained in vertical tracks which are secured to the opposite longitudinal edges of said gantry adjacent to said bellcranks and said rods being formed for reciprocation in said tracks, connecting rods for each of said bellcrank and push rod pairs, said rods having a first end journalled to said push rods and the opposite end thereof journalled to said bellcranks intermediate the ends thereof between said pivoted ends of said bellcranks and said roller engagements therewith, at least a pair of push rod actuators secured to said trolley and aligned with the lower ends of said push rods whereby as said trolley passes said push rod locations during reciprocation of said trolley along said gantry, said push rod actuators actuate said lower ends of said rods to reciprocate vertically upward from said first position orientation in response to longitudinal movement of said actuators whereby the upper ends of said push rods, being individually interconnected by said connecting rods to said bellcranks intermediate to the ends thereof, move said connecting rods and thereby said bellcranks to said second actuated position orientation when said push rods are at their raised positions, whereby said support rollers are retracted clear of said trolley to let said trolley pass without mechanical interference with said rope support rollers, and said push rods lower said bellcranks by means of said connecting rods to said first resting position when said actuators are out of contact with said push rods whereby said support rollers project under and support the adjacent wire ropes.

2. The wire rope reeving support system of claim 1 including at least two pairs of elongated cam surfaces mounted in end to end alignment on opposite longitudinal edges of said crane gantry and disposed in opposed relation across from each other, the adjacent ends of each pair thereof being interconnected and journalled to the lower ends of said push rods, said cam surfaces being journalled at the opposite outboard ends thereof to said gantry whereby said adjacent ends of said cam surfaces reciprocate vertically in unison and said push rod actuators contact said cam surfaces as said trolley traverses the positions of said cam surfaces.

3. The wire rope reeving support system of claim 2 wherein said crane gantry is comprised of two parallel elongated girders and said load suspended from said cargo transport trolley is suspended therebetween and said two pairs of push rods, bellcranks, connecting rods, and cam surfaces are mounted on the opposing interior walls of said girders.

4. The wire rope reeving support system of claim 3 wherein said two pairs of push rods, bellcranks, connecting rods, and cam surfaces are located near mid span of said gantry.

5. The wire rope reeving support system of claim 3 wherein said gantry includes multiple pairs of push rods, bellcranks, connecting rods, and cam surfaces, which are mounted in spaced apart relation intermediate the ends of said gantry.

6. The wire rope reeving support system of claim 3 wherein said bellcranks have at least two wire rope rollers rotatably engaged therewith for supporting both load hoist and trolley drive wire rope reeving.

7. The wire rope reeving support system for a cargo container handling crane having a cargo transport trolley mounted for reciprocation along a horizontal gantry thereof and for suspending a load thereunder, said crane having a fleet through wire rope load hoisting system for said transport trolley driven from a remote location on said crane, said rope support system of the present invention comprising at least two pairs of bellcranks and push rods secured in opposed relation to the opposite longitudinal edges of said gantry intermediate the ends thereof, said bellcranks being pivoted at their respective first ends to said gantry with the opposite ends thereof each having at least one wire rope support roller rotatably engaged therewith and formed to project under and support said adjacent portion of said wire ropes of said wire rope load hoisting system when said bellcranks are oriented in a first resting position and said rollers being formed to retract from under said wires and project clear of said trolley when said bellcranks are oriented in a second actuated position, said push rods being contained in vertical tracks which are secured to the opposite longitudinal edges of said gantry adjacent to said bellcranks and said rods being formed for reciprocation in said tracks, connecting rods for each of said bellcrank and push rod pairs, said rods having a first end journalled to said push rods and the opposite end thereof journalled to said bellcranks intermediate the ends thereof between said pivoted ends of said bellcranks and said roller engagements therewith, at least two pairs of elongated cam surfaces mounted in end to end alignment on opposite longitudinal edges of said crane gantry and disposed in opposed relation across from each other, the adjacent ends of each pair thereof being interconnected and journalled to the lower ends of said push rods, said cam surfaces being journalled at the opposite outboard ends thereof to said gantry whereby said adjacent ends of said cam surfaces reciprocate vertically in unison, and.

at least a pair of cam surface actuators secured to said trolley and aligned with said cam surfaces whereby as said trolley passes said cam surface locations during reciprocation of said trolley along said gantry, said actuators raise said cam surfaces to reciprocate the lower ends of said push rods vertically upward from said first position orientation in response to longitudinal movement of said actuators whereby the upper ends of said push rods, being individually interconnected by said connecting rods to said bellcranks intermediate to the ends thereof, move said connecting rods and thereby said bellcranks to said second actuated position orientation when said push rods are at their raised positions, whereby said support rollers are retracted clear of said trolley to let said trolley pass without mechanical interference with said rope support rollers, and said push rods lower said bellcranks by means of said connecting rods to said first resting position when said actuators are out of contact with said cam surfaces whereby said support rollers project under and support the adjacent wire ropes.

8. A method for supporting the wire rope reeving for a cargo container handling crane having a cargo transport trolley mounted for reciprocation along a horizontal gantry thereof and for suspending a load thereunder, said crane having at least a fleet through wire rope load hoisting system for suspending a cargo container headblock from said transport trolley, the steps comprising providing a pair of wire support rollers in opposing positions on opposite longitudinal edges of said crane gantry, said rollers projecting under those portions of the wire ropes of said wire rope load hoisting system which are disposed proximate to said edges, said rollers each being mounted on one end of a bellcrank pivoted at the other end thereof to structure engaged with said gantry, said bellcranks being actuated by push rods through connecting rods secured between said bellcranks and said push rods, providing push rod actuators on said transport trolley arranged to reciprocate said push rods vertically whereby as said push rods are raised by said actuators said rollers are retracted from under said wires, and when said push rods are lowered by being out of contact with said actuators, said rollers are interposed under said wires, and moving said trolley back and forth along said gantry past the position of the support rollers on said gantry to actuate said push rods to insert and remove said support rollers from under said wire ropes.

9. The method of claim 8 wherein at least two pairs of elongated cam surfaces are provided secured to opposite longitudinal edges of said gantry to provide a controlled reciprocation of said push rods when said push rod actuators reciprocate said cam surfaces vertically when said trolley is passing said surfaces.

* * * * *